United States Patent [19]

Grothe

[11] Patent Number: 4,641,785

[45] Date of Patent: Feb. 10, 1987

[54] FLAT JET NOZZLE FOR COOLANT SPRAYING ON A CONTINUOUSLY CONVEYED BILLET

[75] Inventor: Horst Grothe, Kaarst, Fed. Rep. of Germany

[73] Assignee: SMS Schloemann-Siemag AG, Fed. Rep. of Germany

[21] Appl. No.: 752,939

[22] Filed: Jul. 8, 1985

[30] Foreign Application Priority Data

Jul. 7, 1984 [DE] Fed. Rep. of Germany ..... 3425092

[51] Int. Cl.[4] ..... B22D 11/124

[52] U.S. Cl. ..... 239/597; 239/601; 164/444

[58] Field of Search ..... 164/412, 443, 444, 485, 164/486, 487, 348; 239/597, 599, 601

[56] References Cited

U.S. PATENT DOCUMENTS

| | | | |
|---|---|---|---|
| 3,935,896 | 2/1976 | Tegtmeier et al. | 164/486 |
| 4,424,855 | 1/1984 | Tsubakihara et al. | 164/485 |
| 4,541,473 | 9/1985 | Onoe et al. | 164/486 |
| 4,567,934 | 2/1986 | Nakao et al. | 164/444 |

*Primary Examiner*—Nicholas P. Godici
*Assistant Examiner*—Richard K. Seidel
*Attorney, Agent, or Firm*—Toren, McGeady and Goldberg

[57] ABSTRACT

A flat jet nozzle for spraying coolant on a continuously conveyed billet with a wide angle spray along the width of the billet is formed with a cylindrical wall having a discharge slot extending in the circumferential direction of the cylindrical wall, with the slot having a width which increases from the middle of the slot toward the outer sides thereof.

5 Claims, 7 Drawing Figures

FLAT JET NOZZLE FOR COOLANT SPRAYING ON A CONTINUOUSLY CONVEYED BILLET

The invention is directed to a flat jet nozzle for spraying a coolant or coolant mixture in a wide angle along the widths of a continuously conveyed billet, particularly in slab form, wherein a discharge slot extends in the circumferential direction of a cylindrical wall of the flat jet nozzle.

Such spray nozzles are used in continuous casting installations for cooling of the cast billets where uniform heat removal across the billet width is contemplated.

Flat jet nozzles for continuous casting installations are already known, wherein an outlet gap with a uniform width is arranged in a cylindrical outer surface in a circumferential direction. Here, uniform heat removal across the billet width cannot be achieved because, on the basis of the geometric circumstances, smaller amounts of cooling agent with less energy impinge upon the unit surface of the outer areas which are obliquely impacted than upon unit surfaces of the central areas located vertically beneath the nozzle.

SUMMARY OF THE INVENTION

It is an object of the present invention to provide a simple flat jet nozzle for cooling billets imparting a coolant volume distribution along the billet width effecting a uniform, careful and rapid cooling of the billet surface.

It is another object of the invention to provide a flat jet nozzle with which cooling water as well as a water-air mixture can be applied in a flat, wide-angle spray to a billet surface with a volume ratio which is constant over a wide pressure range for the purpose of uniform heat conveyance.

This object is met, according to the invention, in that the width of the discharge slot increases from its center to its outer sides. In this way, coolant quantities Q directed on width areas of the billet surface are dimensioned while taking into consideration their impingement angle $\alpha$ for the purpose of uniform heat conveyance. The texture and surface quality of the billet is improved and an optimal utilization of the coolant is achieved.

In so doing, the discharge slot can extend prior to an impact surface.

Alternatively, the discharge slot can be arranged at the side of the flat jet nozzle so as to be parallel to the supply opening.

A particularly economical construction of the flat jet nozzle consists in that the discharge slot is partially formed by means of a cover placed on a lateral borehole of the flat jet nozzle, which cover is fastened by means of a pin penetrating through the lateral borehole.

The various features of novelty which characterize the invention are pointed out with particularity in the claims annexed to and forming a part of this disclosure. For a better understanding of the invention, its operating advantages and specific objectives attained by its use, reference should be had to the drawings and descriptive matter in which there are illustrated and described the preferred embodiments of the invention.

DETAILED DESCRIPTION OF THE PREFERRED EMBODIMENTS

Figure 1:
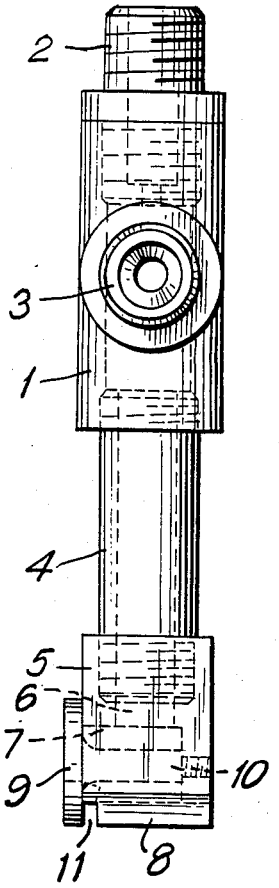
FIG. 1 is a side view of a cooling device consisting of a mixing unit and a flat jet nozzle.
Figure 1A:
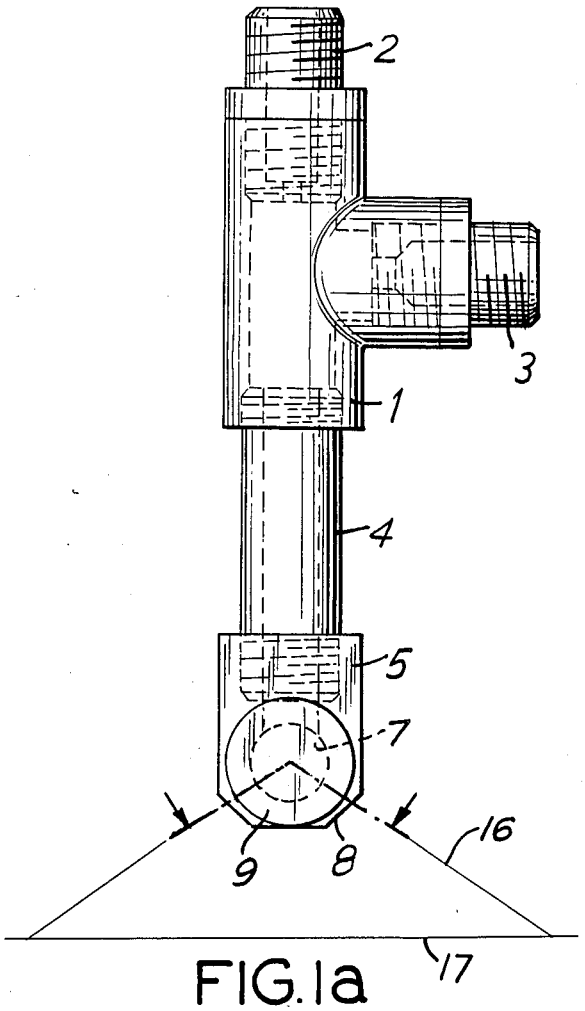
FIG. 1*a* is a front view of the device shown in FIG. 1.
Figure 2:
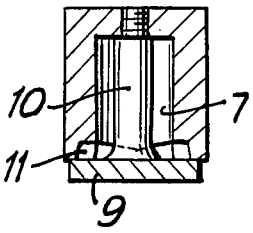
FIG. 2 is a partial section of the jet nozzle shown in FIGS. 1, 1*a;*

The binary cooling device for billets, shown in FIGS. 1, 1*a* and 2, is a T-shaped mixing unit 1 with a connection piece 2, 3 provided in each instance for an air supply line and a water supply line. A nozzle pipe 4 is screwed in at a discharge side of the mixing unit 1 and is adjoined by a flat jet nozzle 5.

The flat jet nozzle 5 is provided with a supply opening 6 and a lateral borehole 7 at a right angle to the latter whose lower wall 8 acts as an impact surface. The lateral borehole 7 is provided with a cover 9 which is fastened at the opposite wall of the flat jet nozzle 5 with a pin 10 penetrating the lateral borehole 7. The lower wall 8 of the flat jet nozzle 5 is angularly recessed at the side of the cover 9 in order to form a discharge slot 11.

Figure 3:
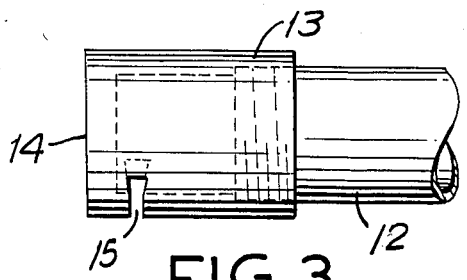
FIG. 3 is a side view of another flat jet nozzle.
Figure 4:
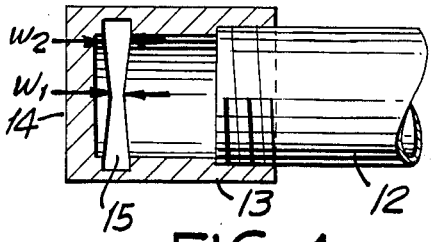
FIG. 4 is a section through the flat jet nozzle.
Figure 5A:
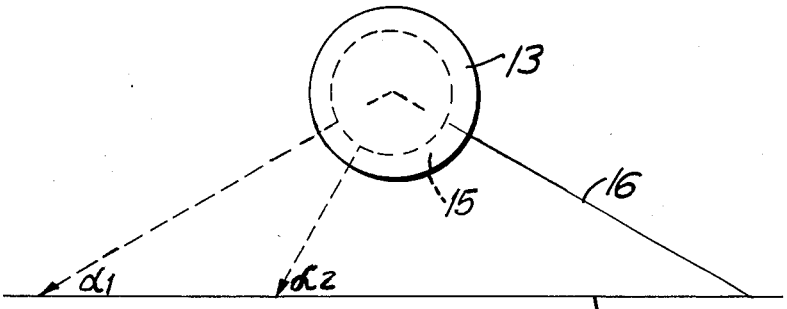
FIG. 5*a* is a schematic front view of the flat jet nozzle with a wide angle spray.
Figure 5:
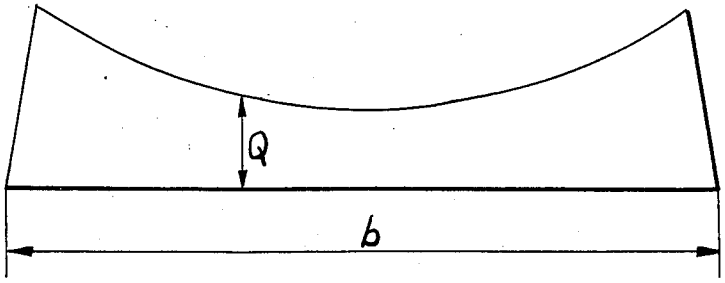
FIG. 5 is a graphical representation of the coolant volume distribution.

In the cooling device shown in FIGS. 3 to 5, a flat jet nozzle 13 which is screwed on at a nozzle pipe 12 is provided with a wall 14 defining an impact surface at the front side thereof and comprising a discharge slot 15.

The coolant is sprayed on a billet surface 17 through the discharge slots 11, 15 of the flat jet nozzle 5 and 13, respectively, in a wide angle spray 16, wherein individual coolant jets of the wide angle spray 16 have different impingement angles $\alpha_1$, $\alpha_2$. In order to achieve a uniform cooling along the billet width b, different coolant quantities Q are determined for the width areas in accordance with the impingement angle $\alpha$. The respective area of the discharge slot 11, 15 is determined with respect to its width in accordance with the required coolant quantities Q. It can be seen from FIGS. 1 to 4 that the width of the discharge slots 11, 15 increases from $w_1$ at the center to $w_2$ at the sides. In this way, the external areas of a billet surface 17 is acted upon with a larger coolant quantity Q in an outwardly increasing and defined manner (FIG. 5).

While specific embodiments of the invention have been shown and described in detail to illustrate the application of the inventive principles, it will be understood that the invention may be embodied otherwise without departing from such principles.

I claim:

1. In a flat jet nozzle for coolant spraying of a continuously conveyed billet, particularly in slab form, with a wide angle spray along a width of said billet, said flat jet nozzle being formed with a cylindrical wall having means defining in said cylindrical wall a discharge slot extending in the circumferential direction of said cylindrical wall, said slot having a middle and outer sides, the improvement comprising that said discharge slot is formed with a width which increases from said middle of said slot to said outer sides thereof.

2. A nozzle according to claim 1, further comprising means defining an impact surface within said nozzle against which coolant impinges, said discharge slot being formed to extend prior to said impact surface taken in the direction of coolant flow in said nozzle.

3. A nozzle according to claim 1, wherein said discharge slot is arranged parallel to a supply opening in a wall of said flat jet nozzle.

4. A nozzle according to claim 1, wherein said discharge slot is partially formed by means of a cover placed on a lateral borehole of said flat jet nozzle.

5. A nozzle according to claim 4, wherein said cover is fastened by means of a pin penetrating through said lateral borehole.

* * * * *